US008258858B2

(12) United States Patent
Spits

(10) Patent No.: US 8,258,858 B2
(45) Date of Patent: Sep. 4, 2012

(54) CIRCUIT FOR GENERATING A CONTROL CURRENT

(75) Inventor: Erwin Spits, Utrecht (NL)

(73) Assignee: EPCOS AG, Munich (DE)

( * ) Notice: Subject to any disclaimer, the term of this patent is extended or adjusted under 35 U.S.C. 154(b) by 7 days.

(21) Appl. No.: 13/040,733

(22) Filed: Mar. 4, 2011

(65) Prior Publication Data

US 2011/0210714 A1 Sep. 1, 2011

Related U.S. Application Data

(63) Continuation of application No. PCT/EP2009/063212, filed on Oct. 9, 2009.

(30) Foreign Application Priority Data

Oct. 10, 2008 (EP) ..... 08166350

(51) Int. Cl.
*G05F 1/10* (2006.01)

(52) U.S. Cl. ..... 327/538; 323/314

(58) Field of Classification Search ..... 323/312, 323/313, 314, 315; 327/538, 539
See application file for complete search history.

(56) References Cited

U.S. PATENT DOCUMENTS 4,525,663 A * 6/1985 Henry ..... 323/280
5,793,194 A 8/1998 Lewis

FOREIGN PATENT DOCUMENTS

JP 2008-154043 A 7/2008
JP 2008-172538 A 7/2008

OTHER PUBLICATIONS

Järvinen, E., et al., "Bias Circuits for GaAs HBT Power Amplifiers," 2001 IEEE MTT-S, 2001, pp. 507-510.

* cited by examiner

*Primary Examiner* — Shawn Riley
(74) *Attorney, Agent, or Firm* — Slater & Matsil, L.L.P.

(57) ABSTRACT

A circuit includes a supply voltage and a control current line including two resistors. A sink current line branches off from the control current line between the resistors. A current sink transistor has an emitter that is connected to the sink current line and a collector that is connected to ground via a first further resistor. At least one reference transistor has an emitter that is connected to its base, to the supply voltage via a second further resistor and to the base of the current sink transistor. The collector of the reference transistor is connected to ground or to an emitter of a further reference transistor, which is switched in a manner similar to the first reference transistor.

12 Claims, 1 Drawing Sheet

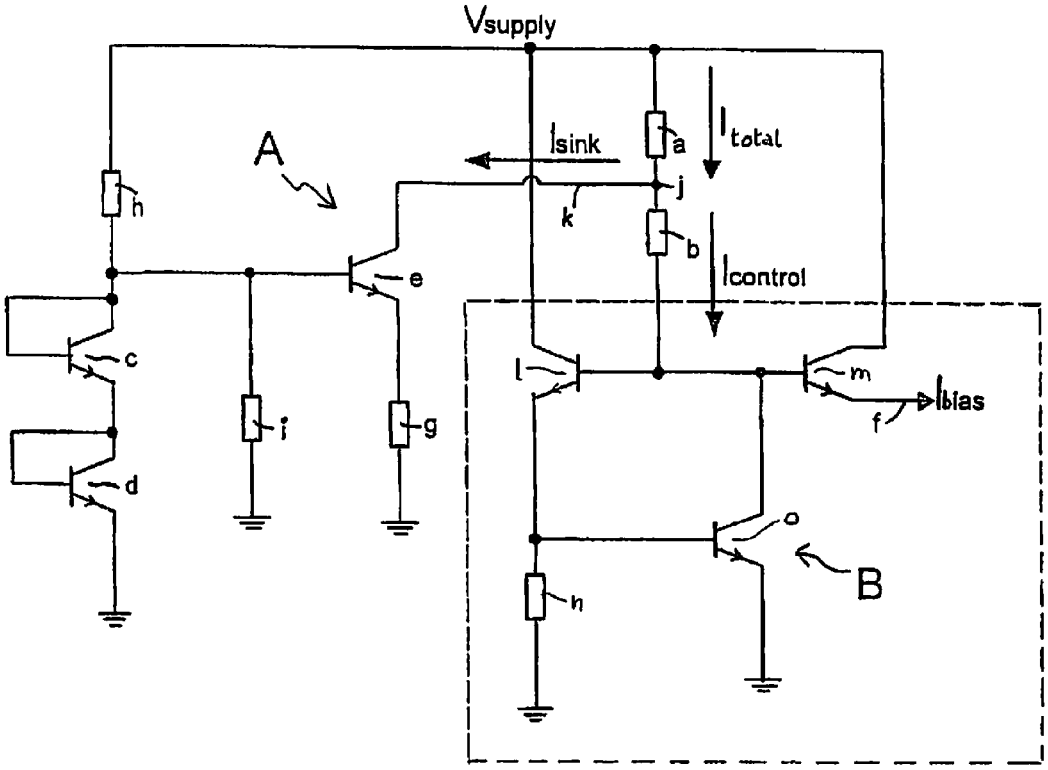
Vsupply
A
Isink
a
Itotal
j
k
b
Icontrol
h
e
c
d
i
g
l
m
Ibias
f
o
B
n

CIRCUIT FOR GENERATING A CONTROL CURRENT

This application is a continuation of co-pending International Application No. PCT/EP2009/063212, filed Oct. 9, 2009, which designated the United States and was not published in English, and which claims priority to European Application No. 08166350.2, filed Oct. 10, 2008, both of which applications are incorporated herein by reference.

TECHNICAL FIELD

This invention is concerned with an electronic circuit for generating a control current that is independent of voltage variations.

BACKGROUND

Due to supply voltage variations, the output current of a standard bias circuit deviates beyond required specifications. Hence a stable reference voltage is required for stable current output. A stable voltage may be generated externally and supplied to the bias circuit, which is applied in an amplifier component, for example. Such an external voltage supply is common use in industrial applications. Existing concepts are discussed in the paper 2001 IEEE MTT-S, "Bias circuits for GaAs HBT power amplifiers", Esko, Jarvinen, pages 507-510.

SUMMARY

In one aspect, the present invention provides a circuit for generating a control current that is independent of voltage variations. This circuit can be especially appropriate for applications of standard bias circuits.

BRIEF DESCRIPTION OF THE DRAWING

The lone FIGURE illustrates a circuit diagram according to an embodiment of the invention.

The following list of reference characters can be used in conjunction with the drawings:

a resistor
b resistor
c reference transistor
d reference transistor
e current sink transistor
f bias current
g first further resistor
h second further resistor
i third further resistor
j control current line
k sink current line
l first transistor of the bias circuit
m second transistor of the bias circuit
n fourth further resistor
o third transistor of the bias circuit

DETAILED DESCRIPTION OF ILLUSTRATIVE EMBODIMENTS

In the following an example of a circuit is given in conjunction with the appended FIGURE.

In one embodiment, the present invention provides a circuit for generating a control current that is independent of voltage variations. The circuit comprises a supply voltage ($V_{supply}$) and a control current line (j) comprising two resistors (a, b). A sink current line (k) branches off from the control current line between the resistors. A current sink transistor (e) has a base, an emitter and a collector. The emitter is connected to the sink current line and the collector is connected to ground via a first further resistor (g).

At least one reference transistor (c) has a base, an emitter and a collector. The emitter of the reference transistor is connected to the base, to the supply voltage via a second further resistor (h) and to the base of the current sink transistor. The collector of the reference transistor is connected to ground or to an emitter of a further reference transistor (d), which is switched in a manner similar to the first reference transistor (c).

The circuit generates a control current or reference current that is independent of voltage variations. The current can especially be provided to be fed into an amplifier bias circuit. The control current is generated by a drop of a supply voltage across a resistor, which is split in two parts to form a voltage divider. Between the parts, a sink current line branches off from the control current line, so that it is possible to sink away current via the sink current line. The remaining current on the control current line can be controlled so as to be maintained at a specified value.

A reference circuit is provided to generate a correction current and uses base-emitter voltages of preferably two small reference transistors. The reference serves to control a transistor, which sinks current in relation to variations of the supply voltage in order to keep the actual control current that is output from the circuit unchanged.

The circuit shown in the diagram of the FIGURE comprises a circuit A for the generation of the control current and, for the purpose of illustration only, an example of a standard bias circuit B. The control current $I_{control}$ is fed into the bias circuit B from the supply voltage $V_{supply}$ via a control current line j. The control current line j comprises two resistors a and b, which are arranged in series and form a voltage divider. A sink current line k branches off from the control current line j between the resistors a, b. The sink current line k is provided for a correction current $I_{sink}$, by which the total current $I_{total}$ through the resistor a is reduced to the control current $I_{control}$ through the resistor b. The correction current $I_{sink}$ is controlled in such a way that the control current $I_{control}$ is maintained on the preset value. To this end, the circuit A is provided, comprising a current sink transistor e and at least one reference transistor c, d.

Preferably two reference transistors c, d are provided, both having their base and emitter connected, so that each reference transistor c, d is switched to operate like a diode. The reference transistors c, d are arranged in series, and the emitter of the first reference transistor c is switched between the resistors h and i, which form a further voltage divider. The collector of the second reference transistor d is connected to ground. The emitter of the first reference transistor c is connected to the base of a transistor e, the current sink transistor, which is provided to generate the correction current $I_{sink}$. The emitter of the current sink transistor e is therefore connected to the sink current line k, and the collector of the current sink transistor e is connected to ground via the resistor g.

The circuit A thus controls the value of the control current $I_{control}$, which is fed into the bias circuit B or into any other circuit using a stable current. In the example shown in the figure, the bias circuit B comprises three transistors. The bases of a first and a second one of these transistors l, m are connected to one another, to the control current line j and to the emitter of the third transistor o. The emitters of the first and second transistors l, m are connected to the supply voltage. The collector of the first transistor l is connected to ground via a further resistor n and to the base of the third transistor o. The collector of the third transistor o is connected to ground, and the collector of the second transistor m supplies a bias current f. The bias circuit B can be substituted with any other circuit that makes use of a control current or reference current. This is indicated in the FIGURE by the rectangular frame of broken lines enclosing part B of the circuitry.

As discussed above, a control current ($I_{control}$), especially a current for a bias circuit that is current controlled, is generated by a voltage drop across a voltage divider formed by resistors (a, b). To make the control current independent of variations of the supply voltage ($V_{supply}$), the control current is corrected by sinking away a correction current ($I_{sink}$) depending on variations of the supply voltage. This is achieved by an arrangement of at least one reference transistor (c, d) and a current sink transistor (e).

What is claimed is:

1. A circuit comprising:

a supply voltage;

a control current line comprising two resistors;

a sink current line branching off from the control current line between the resistors;

a current sink transistor having a base, an emitter and a collector, the emitter being connected to the sink current line and the collector being connected to ground via a first further resistor, and at least one reference transistor having a base, an emitter and a collector, the emitter of the reference transistor being connected to the base, to the supply voltage via a second further resistor and to the base of the current sink transistor, the collector of the reference transistor being connected to ground.

2. The circuit of claim 1, wherein the collector of the reference transistor is connected directly to ground.

3. The circuit of claim 1, wherein the collector of the reference transistor is connected to ground through a further reference transistor.

4. The circuit of claim 1, further comprising a third further resistor, wherein the base of the current sink transistor and the emitter of the reference transistor are connected to ground via the third further resistor.

5. The circuit of claim 1, further comprising a bias circuit based on a reference current, the bias circuit being connected to the supply voltage and to the control current line.

6. The circuit of claim 1, wherein the bias circuit comprises first, second and third transistors, each having a base, an emitter and a collector;

wherein the bases of the first and the second transistors are connected to one another, to the control current line and to the emitter of the third transistor of the bias circuit;

wherein the emitters of the first and second transistors are connected to the supply voltage;

wherein the collector of the first transistor is connected to ground via a fourth further resistor and to the base of the third transistor;

wherein the collector of the third transistor is connected to ground; and wherein the collector of the second transistor supplies a bias current.

7. The circuit of claim 1, wherein the circuit is configured to generate a control current that is independent of voltage variations.

8. A circuit comprising:

a supply voltage;

a control current line comprising two resistors;

a sink current line branching off from the control current line between the resistors;

a current sink transistor having a base, an emitter and a collector, the emitter being connected to the sink current line and the collector being connected to ground via a first further resistor, and at least one reference transistor having a base, an emitter and a collector, the emitter of the reference transistor being connected to the base, to the supply voltage via a second further resistor and to the base of the current sink transistor, the collector of the reference transistor being connected to an emitter of a further reference transistor, which is switched in a manner similar to the first reference transistor.

9. The circuit of claim 8, further comprising a third further resistor, wherein the base of the current sink transistor and the emitter of the reference transistor are connected to ground via the third further resistor.

10. The circuit of claim 8, further comprising a bias circuit based on a reference current, the bias circuit being connected to the supply voltage and to the control current line.

11. The circuit of claim 8, wherein the bias circuit comprises first, second and third transistors, each having a base, an emitter and a collector;

wherein the bases of the first and the second transistors are connected to one another, to the control current line and to the emitter of the third transistor of the bias circuit;

wherein the emitters of the first and second transistors are connected to the supply voltage;

wherein the collector of the first transistor is connected to ground via a fourth further resistor and to the base of the third transistor;

wherein the collector of the third transistor is connected to ground; and wherein the collector of the second transistor supplies a bias current.

12. The circuit of claim 8, wherein the circuit is configured to generate a control current that is independent of voltage variations.

* * * * *